US011426784B2

(12) United States Patent
Flehmig et al.

(10) Patent No.: US 11,426,784 B2
(45) Date of Patent: Aug. 30, 2022

(54) METHOD AND DEVICE FOR PRODUCING COMPONENTS HAVING AN ADJUSTED BOTTOM REAGION

(71) Applicants: ThyssenKrupp Steel Europe AG, Duisburg (DE); thyssenkrupp AG, Essen (DE)

(72) Inventors: Thomas Flehmig, Ratingen (DE); Martin Kibben, Dinslaken (DE); Daniel Nierhoff, Mülheim a. d. Ruhr (DE)

(73) Assignee: thyssenknupp AG, Essen (DE)

( * ) Notice: Subject to any disclaimer, the term of this patent is extended or adjusted under 35 U.S.C. 154(b) by 314 days.

(21) Appl. No.: 16/337,136

(22) PCT Filed: Sep. 28, 2017

(86) PCT No.: PCT/EP2017/074677
§ 371 (c)(1),
(2) Date: Feb. 24, 2020

(87) PCT Pub. No.: WO2018/060360
PCT Pub. Date: Apr. 5, 2018

(65) Prior Publication Data

US 2021/0316355 A1 Oct. 14, 2021

(30) Foreign Application Priority Data

Sep. 29, 2016 (DE) ..... 10 2016 118 419.5

(51) Int. Cl.
*B21D 22/21* (2006.01)
*B21D 51/10* (2006.01)

(52) U.S. Cl.
CPC ..... *B21D 51/10* (2013.01); *B21D 22/21* (2013.01)

(58) Field of Classification Search
CPC ..... B21D 22/20; B21D 22/21; B21D 22/22; B21D 22/02; B21D 22/30; B21D 51/10; B21D 37/02; B21D 37/04
See application file for complete search history.

(56) References Cited

U.S. PATENT DOCUMENTS

2010/0133724 A1* 6/2010 Flehmig ..... B21D 22/21 264/294
2011/0016945 A1* 1/2011 Nakao ..... B21D 22/30 72/358

(Continued)

FOREIGN PATENT DOCUMENTS

CN 103564045 A 2/2014
CN 101758148 B 4/2015

(Continued)

OTHER PUBLICATIONS

International Search Report and Written Opinion with English translation for International Application No. PCT/EP2017/074677 dated Apr. 5, 2018, 10 pages.

(Continued)

*Primary Examiner* — Debra M Sullivan
(74) *Attorney, Agent, or Firm* — RMCK Law Group PLC

(57) ABSTRACT

The invention relates to a method for producing a component, said method comprising: preforming a workpiece to a preformed component having a base region, a side-plate region, and optionally a flange region, such that the preformed component has a material surplus for the side-plate region and/or the base region and/or optionally the flange region; and calibrating the preformed component to an at least in regions finally formed component having a base region, a side-plate region, and optionally a flange region; wherein the base region of the preformed component has substantially the geometry and/or the local cross sections of the base region of the at least in regions finally formed (Continued)

Figure 3A:
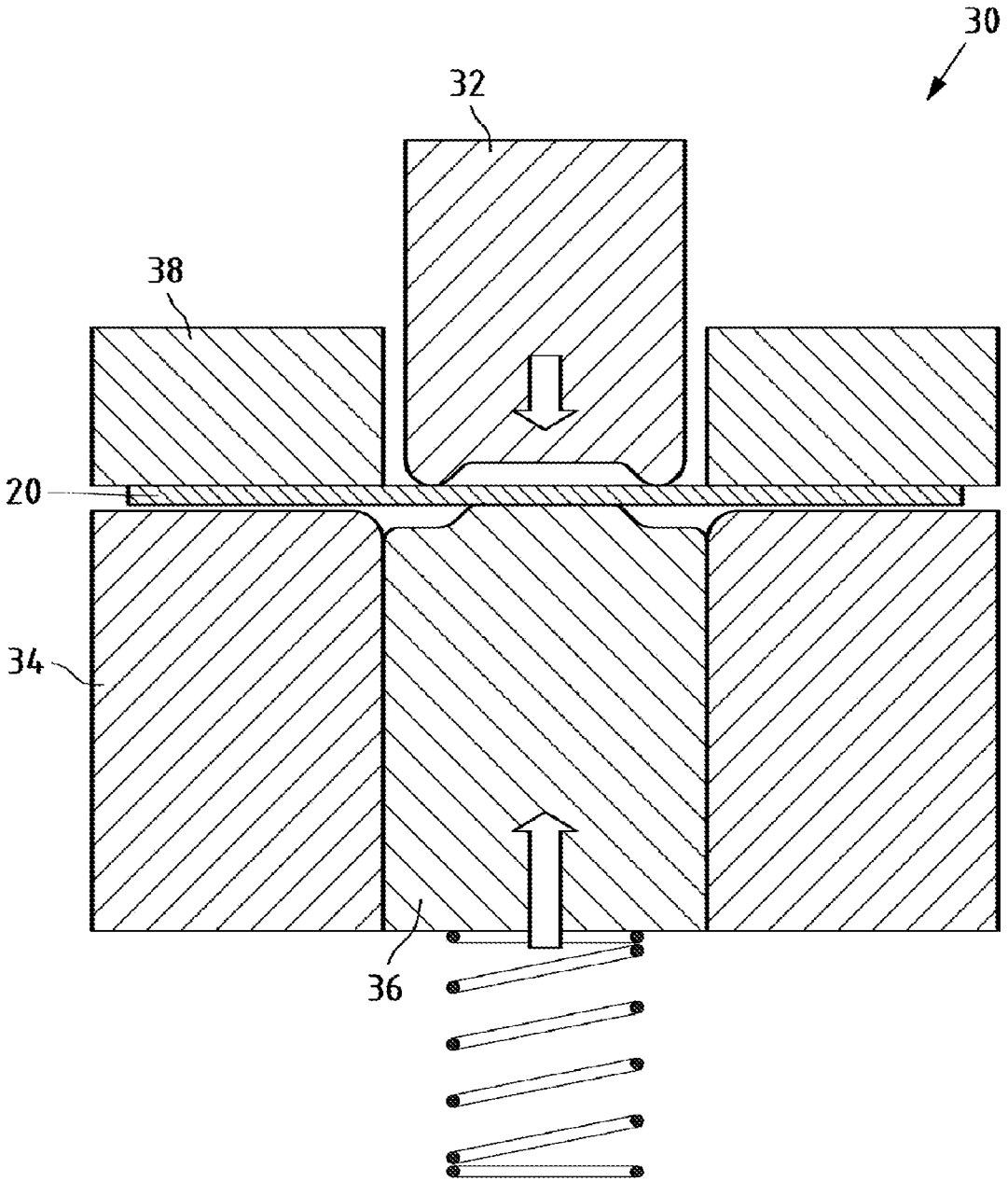

component. The invention moreover relates to a device for producing a component, in particular for carrying out the method.

8 Claims, 5 Drawing Sheets

(56) References Cited

U.S. PATENT DOCUMENTS

| | | | | |
|---|---|---|---|---|
| 2014/0047890 | A1 | 2/2014 | Flehmig | |
| 2014/0356643 | A1 | 12/2014 | Nakata et al. | |
| 2016/0052037 | A1 | 2/2016 | Flehmig et al. | |
| 2016/0067757 | A1* | 3/2016 | Flehmig | B21D 22/30 72/349 |

FOREIGN PATENT DOCUMENTS

| | | | | |
|---|---|---|---|---|
| CN | 104959442 | A | 10/2015 | |
| CN | 105307790 | B | 6/2017 | |
| DE | 102007059251 | A1 * | 6/2009 | B21D 22/30 |
| DE | 102010038354 | A1 | 2/2011 | |
| DE | 102011050002 | A1 | 10/2012 | |
| DE | 102013103612 | A1 | 10/2014 | |
| JP | 2007021568 | A | 2/2007 | |
| JP | 1612494 | B2 | 1/2011 | |
| RU | 2194590 | C2 | 12/2002 | |
| WO | 2014170173 | A1 | 10/2014 | |

OTHER PUBLICATIONS

Search Report of Chinese Office Action for CN Application No. 2017800605519 dated Nov. 26, 2019.

* cited by examiner

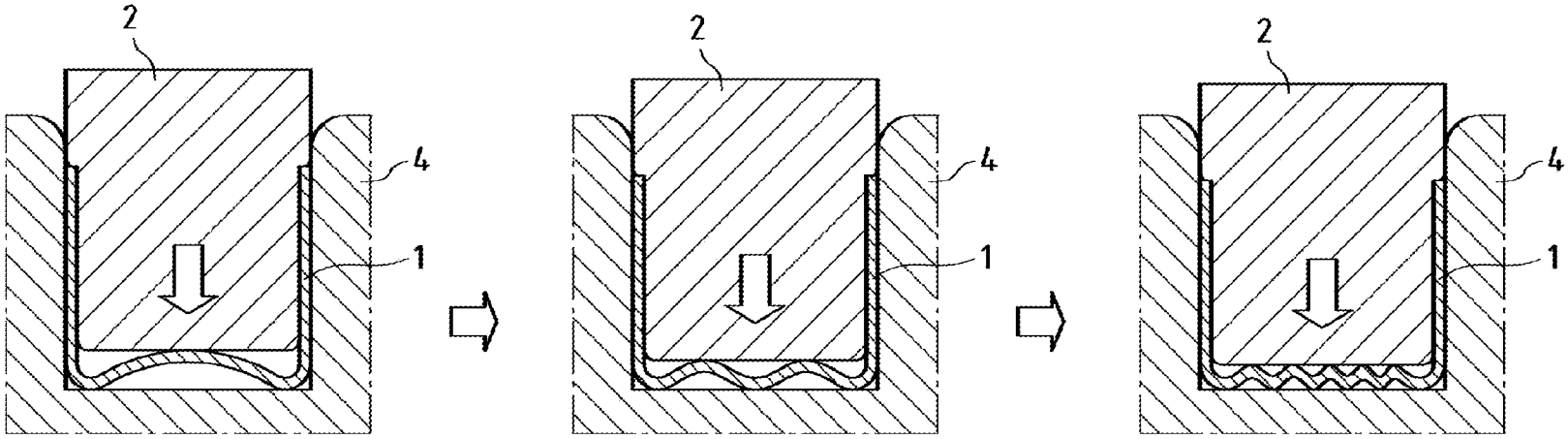
Fig.1a Prior Art
Fig.1b Prior Art
Fig.1c Prior Art
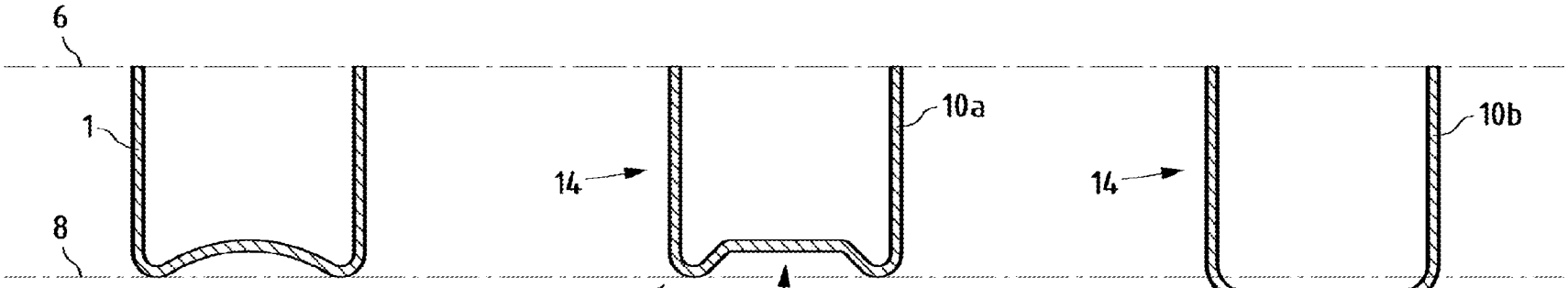
Fig.2a Prior Art
Fig.2b
Fig.2c

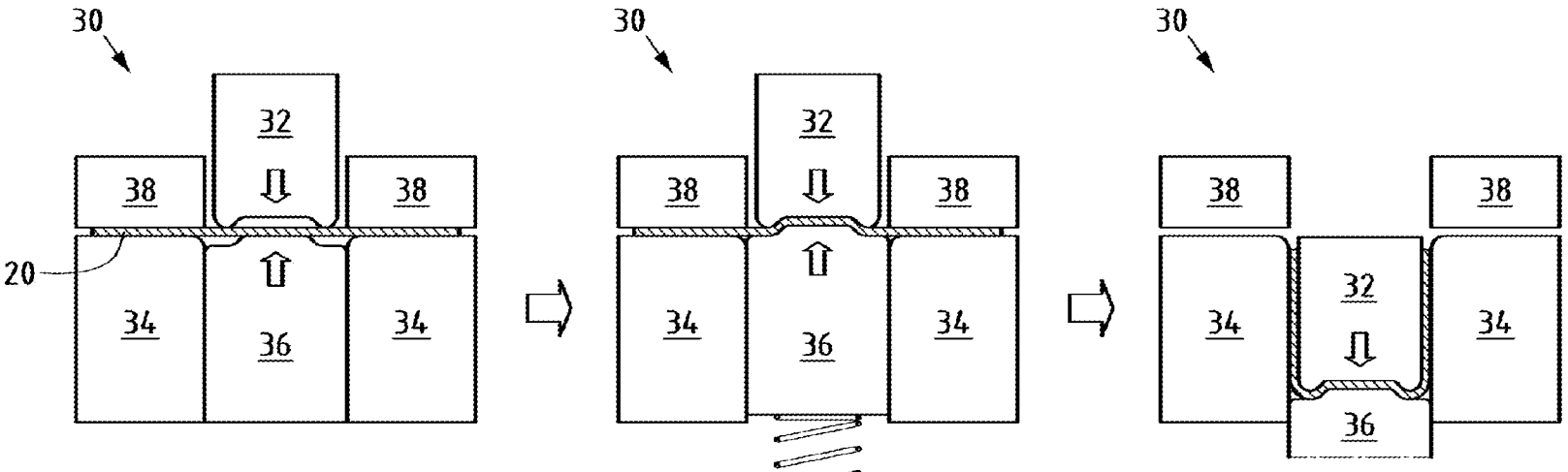
Fig.4a
Fig.4b
Fig.4c
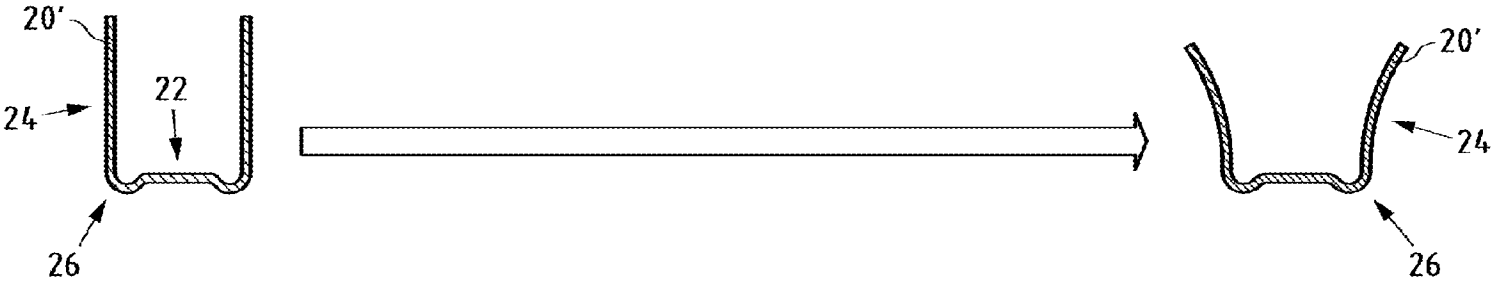
Fig.4d
Fig.4e

METHOD AND DEVICE FOR PRODUCING COMPONENTS HAVING AN ADJUSTED BOTTOM REAGION

CROSS-REFERENCE TO RELATED APPLICATIONS

This application is a 371 U.S. National Stage of International Application No. PCT/EP2017/074677, filed Sep. 28, 2017, which claims priority to German Application No. 10 2016 118 419.5 filed on Sep. 26, 2016. The disclosure of each of the above applications is incorporated herein by reference in their entirety.

FIELD

The invention relates to producing a component with an adapted bottom region and a method for producing the same.

BACKGROUND

In the production of deep-drawn components, in particular open profile components that are U-shaped or hat-shaped in the cross-section, by means of deep drawing, for example, shape changes by virtue of the inevitable elastic rebound arise in most instances after the retrieval of the component from the tool, said changes being, for example, in the form of a rebound between the base and the side plates of the component, or of a curving of the side plate and/or of the base. Consequently, components produced in such a manner are not sufficiently dimensionally true, depending on the application. This effect arises in an amplified manner in the case of high-tensile steel materials or aluminum materials and minor sheet-metal thicknesses.

In order for the above to be counteracted, calibrating is applied, in which calibrating a preformed component (preform) is initially produced, for example by means of deep drawing, so as to have a material surplus (also referred to as a material addition or compression addition). The indifferent rebound of the component that arises in the de-stressing of the component is however subsequently re-aligned on account of a calibrating step by means of superimposing compressive stress such that an at least in regions finally formed, dimensionally true component is created.

In the use of this method in the prior art it is in particular provided that the material surplus for the calibrating procedure is accommodated in the form of one or a plurality of undulations in the base regions. However, when calibrating per se, each undulation in the base region in turn collapses so as to form two or more smaller undulations. Depending on the additional lengths produced by way of the material surplus, said smaller waves in turn fail in the further procedure so as to form even smaller undulations. This effect can be repeated multiple times until the final position of the calibrating die is reached.

The effect described depends on the size of the material surplus, the sheet-metal thickness, the base width, and the undulation height, and in the at least in regions finally formed component leads to deviations from a uniform and/or smooth face (face fault) in the base region, having negative consequences in terms of the surface quality in the form of residual undulations, surface imperfections and/or sheet-metal thickness variations, or combinations of the faults mentioned, respectively.

SUMMARY

Against this background, it is an object of the invention of specifying a method and a device which minimize or avoid the face faults described and even after the calibrating procedure enable sufficiently smooth faces also in the base region of the calibrated component.

One method of the instant application includes preforming a workpiece to a preformed component having a base region, a side-plate region, and optionally a flange region, such that the preformed component has a material surplus for the side-plate region and/or the base region and/or optionally the flange region, and calibrating the preformed component to an at least in regions finally formed component having a base region, a side-plate region, and optionally a flange region. The invention moreover relates to a device for producing a component, in particular for carrying out a method according to the invention, having a preforming tool for preforming a workpiece to a preformed component having a base region, a side-plate region and optionally a flange region, such that the preformed component has a material surplus for the side-plate region and/or the base region and/or optionally the flange region, and having a calibrating tool for calibrating the preformed component to an at least in regions finally formed component having a base region, a side-plate region, and optionally a flange region.

The object according to a first teaching of the invention in the case of a generic method of the invention is achieved in that the base region of the preformed component has substantially the geometry and/or the local cross sections of the base region of the at least in regions finally formed component.

As opposed to the prior art, the divergent approach that the base region of the preformed component has substantially the geometry of the base region of the at least in regions finally formed component is thus pursued. For example, the base region can be configured so as to be planar. The base region when calibrating thus does not have to be subjected to any or only to a minor modification of shape, this further reducing the risk of undesirable face faults in the at least in regions finally formed component. In other words, the base region of the preformed component in terms of the shape thereof can be substantially preserved when calibrating. This is to be understood that the material surplus is thus predominantly provided, for example, in the region of the foot of the side plates and/or of the edge or peripheral region of the base, and uniform regions in the at least in regions finally formed component are also provided as a uniform region in the preformed component, for example. The material surplus is preferably provided only in the peripheral region of the base. The material surplus is particularly preferably provided by the shape of the transition region between the base region and the side-plate region and/or, in as far as a flange region is present, by the shape of the transition region between the flange region and the side-plate region of the preformed component. It has been demonstrated that in this way the advantages of methods for producing dimensionally true components which do not require any or only require minor trimming, can be preserved but face faults in the base region and/or optionally in the flange region can simultaneously be reduced or even avoided.

The base region of the preformed component preferably does not have any material surplus for calibrating, or in the preformed component even has a material deficiency. The material surplus actually required for the base region in this instance is preferably provided substantially by the transition region between the base region and the side-plate region of the preformed component.

A uniform and/or smooth face here is understood to mean that the shape profile of the faces produced according to this invention, in particular of the base region of the at least in regions finally formed component, has only undulations having a small amplitude, for example of less than 0.2 mm, and a large undulation length, for example of more than 10 mm.

The workpiece is, for example, a substantially flat blank, for example a metal sheet. The workpiece is preferably produced from a steel material. However, other metal materials, for example aluminum, can likewise be used. The component is preferably a sheet-metal component.

The preforming is in particular carried out by means of a deep-drawing-type forming which can be carried out in one or multiple stages, for example. Arbitrary combinations of drawing, embossing, raising, edge-bending and/or bending are also conceivable. The path for producing the preformed component can accordingly be followed individually. The preformed component obtained by the preforming can in particular be considered to be a component which is substantially close to the final shape and which, with the exception of ideally minor deviations, already has substantially the envisaged geometry.

The calibrating can thus be in particular to be understood to be a complete forming or final forming of the preformed component which can be achieved, for example, by one or a plurality of pressing procedures. The calibrating comprises in particular a compression procedure. For example, the side-plate region, the base region, optionally the flange region, and/or the transition regions of the preformed component herein are subjected to compressing.

However, it is possible that the at least in regions finally formed component can be subjected to further processing steps such as the incorporation of connection bores and/or a trimming procedure and/or post-forming such as, for example, metal spinning and/or bending. However, no further steps for imparting the major shape are preferably required.

The preforming and calibrating described are preferably performed successively.

DETAILED DESCRIPTION OF FIGURES

The invention is furthermore to be explained in more detail by means of an exemplary embodiment in conjunction with the drawing in which:

FIGS. 1*a-c* show a schematic illustration of calibrating according to the prior art;

FIG. 2*a* shows a schematic illustration of a preformed component according to the prior art;

FIGS. 2*b, c* show schematic illustrations of exemplary preformed components from exemplary embodiments of methods according to the invention;

FIGS. 3*a, b* show schematic illustrations of an exemplary preforming tool and of an exemplary calibrating tool according to an exemplary embodiment of a device according to the invention; and FIG. 4 shows a schematic illustration of a sequence of an exemplary embodiment of a method according to the invention.

DETAILED DESCRIPTION

According to one preferred design embodiment of the method according to the invention, the shape of the transition region between the base region and the side-plate region of the preformed component leads to an elevated or lowered base region of the preformed component. On account thereof, a sufficient material surplus in the transition region can be incorporated in the preformed component, without however having to modify the geometry of the entire base region to this end. Rather, the base region can overall be elevated or lowered. An elevated base region is preferably achieved by a transition region that is substantially U-shaped in the cross section. Substantially uniform elevating or lowering is in particular provided across the entire base region. The base region of the preformed component is elevated or lowered in particular in comparison to the side-plate foot. When viewed in comparison to the base region of the completely shaped component, the base region of the preformed component is thus in particular likewise elevated or lowered. An elevated or lowered base region is understood to be a base region which, in particular proceeding from the same side-plate end level or side-plate head (length level), is elevated or lowered as compared to the lower base level (zero level) of a component in which the same material surplus is achieved by one or a plurality of base undulations that extend across the entire base region.

According to one preferred design embodiment of the method according to the invention, the material surplus is provided substantially or exclusively, respectively, by the transition region between the base region and the side-plate region of the preformed component. On account thereof, no further geometric modifications are required in the base region of the preformed component in order for a material surplus to be provided. This enables in particular a smooth base region which has few faults on the at least in regions finally formed component.

According to one preferred design embodiment of the method according to the invention, the shape of the transition region between the base region and the side-plate region of the preformed component, when viewed in the cross-section, provides an additional length for the base region and/or the side-plate region of the preformed component. On account of the material surplus being provided in the form of an additional length, the risk of material faults and uneven faces on the at least in regions finally formed component is furthermore reduced, for example as opposed to a material surplus in the form of undulations distributed in the base region.

According to one preferred design embodiment of the method according to the invention, a material flow into the side-plate region of the preformed component is achieved by calibrating the preformed component to the at least in regions finally formed component. For example, the material flow is performed from the transition region and/or the base region of the preformed component. This can have the advantage, on the one hand, that no additional lengthening of the side-plate region of the preformed component is required on account of the material surplus, since sufficient material can be provided in the side-plate region by the material flow.

According to one preferred design embodiment of the method according to the invention the preforming is carried out by a deep-drawing-type operation with or without blank holders. The material guiding and the processed stability are improved by preforming using preferably spaced-apart blank holders. However, the blank holders when deep drawing can be dispensed with in the case of components having a simple geometry such as, for example, components that are U-shaped or hat-shaped in the cross section. This embodiment is also referred to, for example, as embossing the base while raising the side-plates. This procedure can be selectively represented in one or a plurality of process steps.

According to one preferred design embodiment of the method according to the invention the base region of the preformed component during calibrating is impinged with a force which enables compressing of the base region of the preformed component and substantially avoids collapsing of the material surplus. For example, the base region is impinged with a force on both sides. On account thereof, a solidification is achieved in the base region when compressing the base, without however provoking any face faults.

According to one preferred design embodiment of the method according to the invention the preforming is carried out in a preforming tool comprising a preforming die, a preforming swage, and a preforming swage base that is movable relative to the preforming swage, wherein the workpiece is disposed between the preforming die and the preforming swage base, and wherein the workpiece is preformed by a relative movement between the work piece, conjointly with the preforming die and the preforming swage base, on the one hand, and the preforming swage, on the other hand. For example, the workpiece is fixed, for example jammed, between the preforming die and the preforming swage base. Optionally, blank holders or metal-sheet holders which in particular in the case of comparatively complex component geometries enable reliable forming can moreover be provided. The preforming by means of the embodiment can be implemented with a minor complexity in terms of process technology and can in particular be integrated in the press-based method.

According to one preferred design embodiment of the method according to the invention the calibrating is carried out by a calibrating tool comprising a calibrating die, a calibrating swage, and a calibrating swage base that is movable relative to the calibrating swage, wherein the preformed component is disposed between the calibrating die and the calibrating swage base, and wherein the preformed component is calibrated by a relative movement between the preformed component, conjointly with the calibrating die and the calibrating swage base, on the one hand, and the calibrating swage, on the other hand. The forces acting when calibrating can be particularly precisely controlled in terms of time and location on account of a separate embodiment of the calibrating swage and of the calibrating swage base. Moreover, the calibrating by means of the embodiment can also be implemented with a minor complexity in terms of process technology and can in particular be integrated in the press-based method.

According to one preferred design embodiment of the method according to the invention, for calibrating the preformed component, calibrating swage side plates of the calibrating tool that define the side-plate region of the at least in regions finally formed component are converged. The preformed component can thus be initially placed into the calibrating tool at open calibrating swage side plates which can subsequently be closed. This enables in particular even heavily rebounded components to be placed into the calibrating tool in a process-reliable manner.

According to one preferred design embodiment of the method according to the invention the calibrating swage side plates of the calibrating tool that are utilized for calibrating the preformed component can be designed in such a manner that the calibrating swage side plates can preferably be repositioned in the optional flange region of the preformed component.

According to a second teaching of the invention, the object mentioned at the outset in the case of a generic device is achieved in that the preforming tool is configured for preforming the workpiece in such a manner that the material surplus is provided substantially by the shape of the transition region between the base region and the side-plate region, and optionally substantially by the shape of the transition region between the flange region and the side-plate region of the preformed component. This is achieved, for example, by the geometry of the preforming tool, for example of the preforming die and/or the preforming swage base of the preforming tool. As has already been discussed, on account of the device the material surplus is thus not provided as before so as to be distributed across the entire base region of the preformed component (for example in the form of one or a plurality of undulations), but instead rather is provided substantially in the transition region between the base region and the side-plate region, and optionally substantially by the shape of the transition region between the flange region and the side-plate region of the preformed component. The advantages of methods for producing dimensionally true components can thus be combined with further reduced or even avoided face faults in the base region.

According to one preferred design embodiment of the device according to the invention the preforming tool comprises a preforming die, a preforming swage, and a preforming swage base that is movable relative to the preforming swage. This enables the workpiece to be disposed between the preforming die and the preforming swage base and, on account thereof, for the workpiece to be preferably fixed and to be preformed by a relative movement between the workpiece, conjointly with the preforming die and the preforming swage base, on the one hand, and the preforming swage, on the other hand. The preforming tool moreover optionally has in particular external blank holders or metal-sheet holders which can positively control the material flow in particular in the case of comparatively complex component geometries so as to guarantee forming that is in particular free of folds. The preforming by means of the embodiment can be implemented with a low complexity in terms of process technology, and the preforming tool can in particular be integrated in a press.

According to one preferred design embodiment of the device according to the invention, the calibrating tool comprises a calibrating die, a calibrating swage, and a calibrating swage base that is movable relative to the calibrating swage. On account thereof, the preformed component can be disposed and preferably fixed between the calibrating die and the calibrating swage base. The preformed component can then be calibrated by a relative movement between the preformed component, conjointly with the calibrating die and the calibrating swage base, on the one hand, and the calibrating swage, on the other hand. As has already been discussed, the forces acting when calibrating can be precisely controlled in terms of time and location on account of a separate embodiment of the calibrating swage and of the calibrating swage base. Moreover, the calibrating can be implemented with a minor complexity in terms of process technology, and the calibrating tool can in particular be integrated in a press.

According to one alternative design embodiment of the device according to the invention the movable calibrating swage base can be dispensed with. In this case, leading, sprung mold pieces which in advance push the component into the swage can be provided in the calibrating die in order for the preformed component to be introduced into the tool in the calibrating procedure. The sprung mold pieces are then displaced into the die when the tool closes. A simpler construction of the tool results on account thereof.

According to one preferred design embodiment of the device according to the invention the calibrating swage comprises at least two separate calibrating swage side plates that are movable in relation to one another. The preformed component can thus initially be placed into the calibrating tool at opened calibrating swage side plates which can subsequently be closed, this facilitating the placing of preformed components that heavily rebound.

In terms of further design embodiments of the device according to the invention, reference is made to the explanations pertaining to the method according to the invention.

By way of the preceding and following description of method steps according to preferred embodiments of the method, corresponding means for carrying out the method steps by way of preferred embodiments of the device are also intended to be disclosed. The corresponding method step is likewise intended to be disclosed by way of the disclosure of means for carrying out a method step.

FIGS. 1*a-c* first show a schematic illustration of calibrating according to the prior art. In the prior art it is provided that a material surplus for the calibrating procedure is provided in the form of one or a plurality of undulations in the base regions of a preformed component 1 and thus to be distributed across the entire base region (FIG. 1*a*). However, when calibrating by means of a compression die 2 and a compression swage 4, each undulation in the base region of the component 1 in turn collapses so as to form two or more smaller undulations (FIG. 1*b*). Depending on the additional lengths produced by the material surplus, said smaller undulations in the further process in turn fail so as to form in each case two even smaller undulations of a higher-order (FIG. 1*c*). This effect can be repeated multiple times until the final position of the calibrating die is reached.

FIG. 2*a* shows a schematic illustration of the preformed component 1 from FIG. 1, according to the prior art. The component 1, in particular in the base region thereof, has surplus material in the form of a base undulation that extends across the entire base region. The dashed line 6 herein indicates the side-plate end level or the length level that is aligned at the end of the side plates. The dashed line 8 indicates the lower base level (zero level) of the preformed component 1.

FIGS. 2*b*, c now show schematic illustrations of exemplary preformed components 10*a*, 10*b* which are produced in the context of exemplary embodiments of methods according to the invention. In the case of the components 10*a*, 10*b* the material surplus is provided by the shape of the transition region 16 between the base region 12 and the side-plate region 14 of the preformed component. The shape of the transition region 16 between the base region 12 and the side-plate region 14 of the preformed components 10*a*, 10*b* leads to a base region of the preformed component that is elevated beyond the zero level (FIG. 2*b*) or is lowered below the zero level 8 (FIG. 2*c*). The material surplus herein is provided exclusively by the respective transition region 16 between the base region 12 and the side-plate region 14 of the preformed component 10*a*, 10*b*. The base region 12 of the preformed component 10*a*, 10*b* is in each case configured so as to be planar, and thus already has substantially the envisaged planar nominal geometry of the at least in regions finally formed base region. The additional length, when viewed in the cross section, that is provided by the surplus material for the side-plate region and the base region is identical in FIGS. 2*a* to 2*c*.

An exemplary embodiment of a device according to the invention and an exemplary embodiment of a method according to the invention are to be described hereunder in conjunction with FIG. 3 and FIG. 4. FIGS. 3*a*, *b* herein show schematic illustrations of an exemplary preforming tool 30 and of an exemplary calibrating tool 40 according to an exemplary embodiment of a device according to the invention, while FIG. 4 shows a schematic illustration of a sequence of an exemplary embodiment of a method according to the invention.

The preforming tool 30 is specified for preforming a workpiece 20 to a preformed component 20' having a base region 22 and a side-plate region 24, such that the preformed component 20' has a material surplus for the side-plate region 24 and/or the base region 22. The preforming tool 30 comprises a preforming die 32, a preforming swage 34, and a preforming swage base 36 that is movable relative to the preforming swage 34. The preforming tool 30 moreover comprises an optional blank holder 38. The elevatable preforming swage base 36 in the shape thereof herein is modified such that a shaping according to FIG. 2*b* (or alternatively corresponding to 2*c*) is achieved by means of the preforming tool.

Alternatively and not illustrated here, the production of the preformed component in a first step can be performed by means of at least in portions embossing the base region and in a second or further step raising or edge-bending the side-plate region.

The calibrating tool 40 serves for calibrating the preformed component 20' to an at least in regions finally formed component 20" having a base region 22 and a side-plate region 24. The calibrating tool 40 comprises a calibrating die 42, a calibrating swage 44, and a calibrating swage base 46 that is movable relative to the calibrating swage 44. The calibrating swage base 46 by way of suitable means such as external fixed spacers can be moved so as to be spaced apart from the calibrating die 42. The calibrating swage 44 comprises two separate calibrating swage side plates 44*a*, 44*b* which are movable in relation to one another and are laterally actuatable. In the course of the process, the calibrating tool 40 can close wherein the calibrating die 42 can displace the calibrating swage base 46 having the preformed component therebetween into the then closed calibrating swage side plates 44*a*, 44*b* (cf. also FIG. 4*g*), such that the elevated base region 22 of the preformed component is levelled and the side-plate region 24 is compressed to the nominal dimension (cf. also FIG. 4*h*).

In the method sequence, the movable preforming swage base 36 is initially extended to the height of the swage bearing face of the preforming swage 34, or so as to be just thereabove. The workpiece 20 (blank) is subsequently placed into the preforming tool 30 (FIG. 3*a*, 4*a*) and is optionally secured against displacement (FIG. 4*b*) on guide pins and/or on bores between the blank holders 38 which are embodied so as to be fixedly spaced apart from the preforming swage 34. In the case of simply designed components (predominantly U-shaped or hat-profile-shaped components) the optionally spaced-apart blank holders 38 can be dispensed with and so-called embossing can be carried out by raising. Only pins on the edges or bores herein secure the workpiece 20 until the workpiece 20 is embossed in a form-fitting manner between the preforming die 32 and the preforming swage base 36.

The unit of the preforming die 32 and the preforming swage base 36 is now furthermore lowered to the lower terminal position (FIG. 4*c*). This leads to the side-plate regions 24 of the preformed component 20'being molded. The preformed component 20' can subsequently be retrieved from the pre-forming tool 30. A rebound arises in particular herein in the side-plate region 24 (FIG. 4*d*, 4*e*). The preformed component 20' is now incorporated in the calibrating tool 40.

Figure 3B:
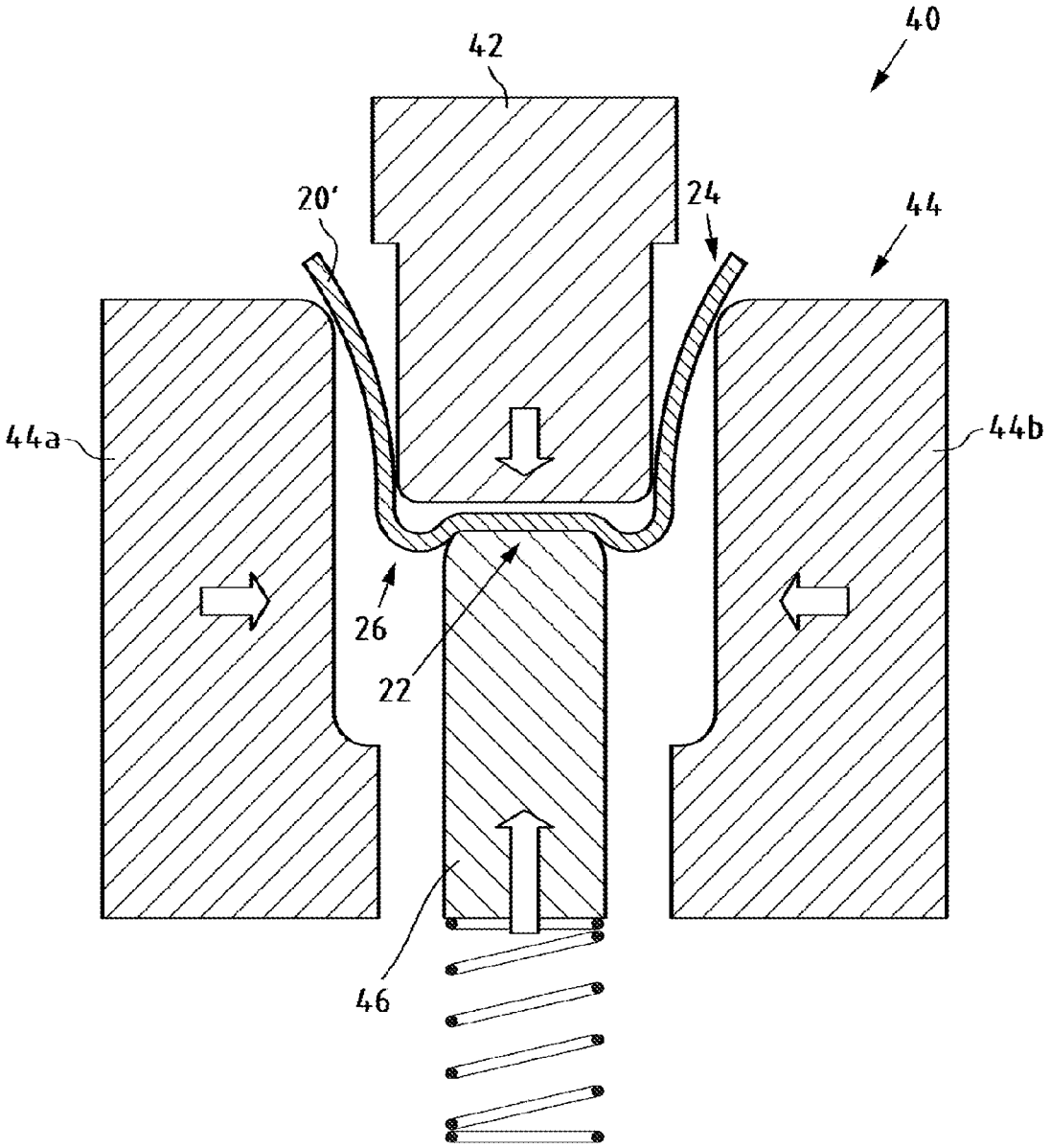
Figure 4H:
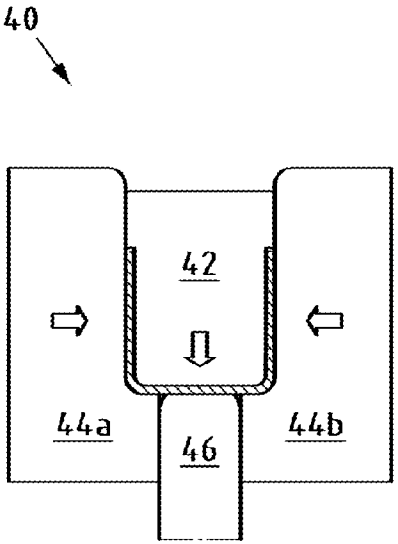
Figure 4G:
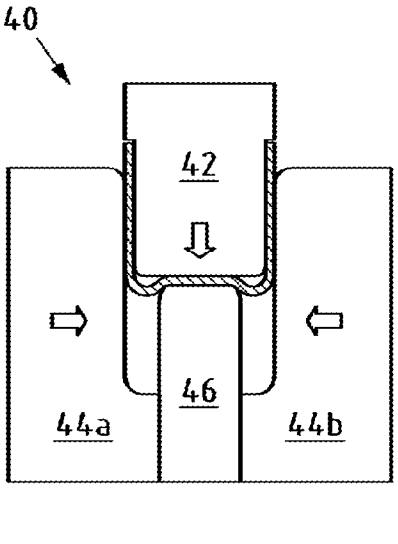
Figure 4F:
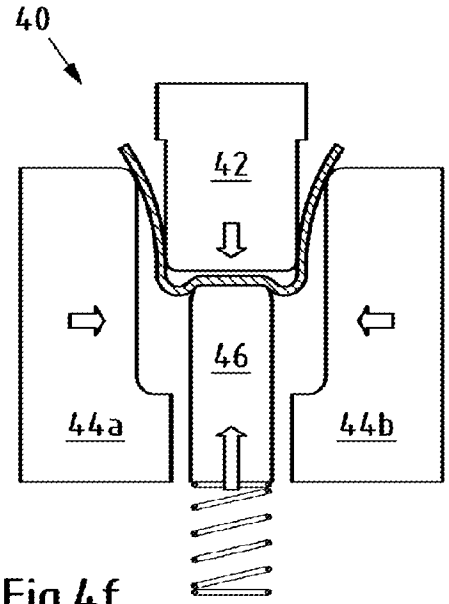
Figure 4J:
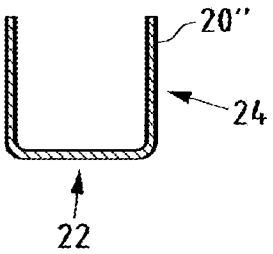

Prior to the preformed component 20' being placed, the calibrating swage base 46 has already been elevated in a defined manner up to a height which contacts the base region 22 of the preformed component 20' placed therein. The loading with the preformed component 20' is then performed, wherein the preformed component 20' at the beginning of the process should preferably be located in a stable position between the two calibrating swage side plates 44*a*, 44*b* and the calibrating swage base 46 (FIG. 3*b*, FIG. 4*f*).

The calibrating die 42 and the calibrating swage base 46 are subsequently closed toward one another so as to be spaced apart, wherein the base region 22 of the preformed component 20' is secured and is substantially not jammed. This enables a largely free material flow in the base region 22 without hampering the calibrating effect that takes place later, but substantially prevents the formation of undulations in the base region 22 on account of the compression stress created during the calibrating. Once the calibrating die 42 has secured the base region 22 of the preformed component 20' against major slippage between said calibrating die 42 and the elevated calibrating swage base 46, the two calibrating swage side plates 44*a*, 44*b* move toward the calibrating die 42 so far until the exactly defined calibrating gap is established between the calibrating swage side plates 44*a*, 44*b* and the calibrating die 42, and the rebounded side-plate region 24 of the preformed component 20' is aligned therein (FIG. 4*g*).

In the further sequence, the calibrating die 42 is lowered downward to the terminal position thereof. Said calibrating die 42 herein likewise displaces the calibrating swage base 46 downward, said calibrating swage base 46 being guided so as to be elevated, but spaced apart from the calibrating die 42 and being provided with a sufficient counterforce (in order to maintain this spacing). The elevation of the base region 22 of the preformed component 20' is removed only in the last portion of this path, in that the material largely flows by way of the transition region 26 in the direction of the side-plate region 24 (FIG. 4*h*). The counterforce of the calibrating swage base 46 herein is preferably to be chosen so high that the compression of the preformed component 20' can also act into the unit of the calibrating die 42 and the calibrating swage base 46, however without simultaneously causing the material surplus to collapse in undulations.

The flow of the material mainly in the transition region 26 has a plurality of advantages. The base region 22 of the preformed component 20' in terms of the shape thereof is substantially maintained, on the one hand. Furthermore, the material displacement into the side-plate region 24 can be chosen to be so large that a lengthening of the side-plate region can optionally also be dispensed with. Lastly, the material flow in the transition region 26 can be utilized for positively influencing the angles of attack of the side-plate region 24 toward the base region 22.

Figure 4I:
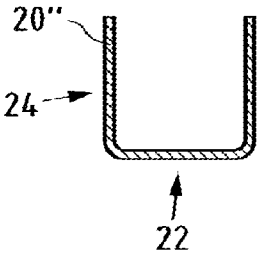

The component 20" in the lower dead center is ultimately at least in portions finally formed and completely calibrated. The compressing procedure has thus taken place in a targeted manner, and the residual undulation in the base is significantly reduced or even entirely avoided (FIG. 4*i*, *j*).

The exemplary method and the exemplary device here have been explained in more detail by means of a flangeless component. Flanged components are subjected to an analogous procedure.

The invention claimed is:

1. A method for producing a component, said method comprising the following steps:

preforming a workpiece to a preformed component having a base region, a side-plate region, and a transition region such that the preformed component has a material surplus wherein the preforming is carried out in a preforming tool comprising a preforming die, a preforming swage, and a preforming swage base that is movable relative to the preforming swage, wherein the workpiece is disposed between the preforming die and the preforming swage base, and wherein the workpiece is preformed by a relative movement between (i) the preforming die and the preforming swage base, (ii) the preforming swage base and the preforming swage, and (iii) the preforming die and the preforming swage; and calibrating the preformed component to the component having a base region, a side-plate region, and a transition region; wherein the base region of the preformed component during calibration is impinged with a force on both sides thereof which enables compressing of the base region of the preformed component and avoids collapsing of the material surplus, wherein the base region of the preformed component has substantially at least one of a geometry and a local cross section of the base region of the component, wherein the material surplus is provided by the transition region between the base region and the side-plate region of the preformed component.

2. The method as claimed in claim 1, wherein the shape of the transition region between the base region and the side-plate region of the preformed component leads to an elevated or lowered base region of the preformed component.

3. The method as claimed in claim 1 wherein the material surplus is provided substantially by the transition region between the base region and the side-plate region of the preformed component.

4. The method as claimed in claim 1 wherein the shape of the transition region between the base region and the side-plate region of the preformed component, when viewed in the cross section, provides an additional length for at least one of the base region and the side-plate region of the preformed component.

5. The method as claimed in claim 1 wherein the preforming is carried out by a deep drawing operation with or without blank holders.

6. The method as claimed in claim 1 wherein the calibrating is carried out by a calibrating tool comprising a calibrating die, a calibrating swage, and a calibrating swage base that is movable relative to the calibrating swage, wherein the preformed component is disposed between the calibrating die and the calibrating swage base, and wherein the preformed component is calibrated by a relative movement between (i) the calibrating die and the calibrating swage base, and (ii) the calibrating swage base and the calibrating swage.

7. The method as claimed in claim 6, wherein the calibrating swage comprises calibrating swage side plates and wherein during the calibrating of the preformed component, the swage side plates converge toward each other.

8. A method for producing a component, said method comprising the following steps:

preforming a workpiece to a preformed component having a base region, a side-plate region, and a transition region such that the preformed component has a material surplus; and calibrating the preformed component to the component having a base region, a side-plate region, and a transition region; wherein the base region of the preformed component during calibration is impinged with a force on both sides thereof which enables compressing of the base region of the preformed component and avoids collapsing of the material surplus, wherein the base region of the preformed component has substantially at least one of a geometry and a local cross section of the base region of the component, wherein the material surplus is provided by the transition region between the base region and the side-plate region of the preformed component; and wherein the calibrating is carried out by a calibrating tool comprising a calibrating die, a calibrating swage, and a calibrating swage base that is movable relative to the calibrating swage, wherein the preformed component is disposed between the calibrating die and the calibrating swage base, and wherein the preformed component is calibrated by a relative movement between (i) the calibrating die and the calibrating swage base, and (ii) the calibrating swage base and the calibrating swage; wherein the calibrating swage comprises calibrating swage side plates and wherein during the calibrating of the preformed component, the swage side plates converge toward each other.

* * * * *